US007734198B2

(12) United States Patent
Higashiyama et al.

(10) Patent No.: US 7,734,198 B2
(45) Date of Patent: Jun. 8, 2010

(54) IMAGE FORMING APPARATUS AND WIRELESS COMMUNICATION DEVICE

(75) Inventors: Makoto Higashiyama, Kanagawa (JP); Kazumasa Koike, Kanagawa (JP); Shingo Nishizaki, Kanagawa (JP); Kazuyuki Sato, Kanagawa (JP); Toyokazu Aoki, Tokyo (JP); Masaki Tsugawa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 272 days.

(21) Appl. No.: 11/892,182

(22) Filed: Aug. 21, 2007

(65) Prior Publication Data

US 2008/0044195 A1 Feb. 21, 2008

(30) Foreign Application Priority Data

Aug. 21, 2006 (JP) ..... 2006-224285
Jul. 5, 2007 (JP) ..... 2007-176981

(51) Int. Cl.
*G03G 15/00* (2006.01)
*G03G 15/08* (2006.01)

(52) U.S. Cl. ..... 399/12; 399/24; 399/27

(58) Field of Classification Search ..... 399/12, 399/13, 24, 27, 53, 258, 262
See application file for complete search history.

(56) References Cited

U.S. PATENT DOCUMENTS

2005/0013633 A1* 1/2005 Harumoto ..... 399/258
2005/0220462 A1* 10/2005 Miyaji ..... 399/24
2005/0286914 A1 12/2005 Nagahama
2006/0029406 A1* 2/2006 Nagahama et al. ..... 399/27

FOREIGN PATENT DOCUMENTS

CN 1716123 1/2006
JP 2003-195690 7/2003
JP 2003-271042 9/2003
JP 2005-115343 4/2005
JP 2005-234499 9/2005

OTHER PUBLICATIONS

Chinese Office Action dated Jun. 5, 2009 for corresponding Chinese Application No. 200710141625.X and English translation thereof.

* cited by examiner

*Primary Examiner*—Sandra L Brase
(74) *Attorney, Agent, or Firm*—Harness, Dickey & Pierce, P.L.C.

(57) ABSTRACT

An image forming apparatus includes a rotating member that is rotatable, a communication medium, and a receiving unit. The communication medium that is attached to an outer circumference of the rotating member stores therein information on the rotating member and relays the information on the rotating member via wireless communication. The receiving unit receives the information on the rotating member from the communication medium.

19 Claims, 10 Drawing Sheets

IMAGE FORMING APPARATUS AND WIRELESS COMMUNICATION DEVICE

CROSS-REFERENCE TO RELATED APPLICATIONS

The present application claims priority to and incorporates by reference the entire contents of Japanese priority documents, 2006-224285 filed in Japan on Aug. 21, 2006 and 2007-176981 filed in Japan on Jul. 5, 2007.

BACKGROUND OF THE INVENTION

1. Field of the Invention

The present invention relates to an image forming apparatus and a wireless communication device.

2. Description of the Related Art

In recent years, color image forming apparatuses that perform color processing on images have been widespread. In such a color image forming apparatus, a single-color toner image is formed from each of colors, such as cyan, magenta, yellow, and black, and then these single-color toner images are sequentially transferred onto a recording medium, thereby forming a full-color image on the recording member. The toner for use in image formation is supplied from removable toner bottles. Thus, in order to prevent each toner bottle from being placed at a wrong position, a technology has been generally known in which an RFID (radio frequency identification) tag, which is a non-contact communication storage medium, is placed at a fixing unit of the toner bottle, and an RFID reader on an apparatus body side receives information from the tag to check the set position, thereby preventing the toner bottle from being wrongly set. In this technology, since the RFID reader has to be placed at an apparatus body side for each RFID tag placed at each toner bottle, the number of RFID readers to be placed is disadvantageously large.

To solve the problems, Japanese Patent Application Laid-Open Publication No. 2003-271042 discloses an image forming apparatus in which an RFID reader is provided between RFID tags placed at fixing units of two toner bottles. In such an image forming apparatus, all what is required is to place one RFID reader for two toner bottles, thereby reducing the number of RFID readers to be placed.

Japanese Patent Application Laid-Open Publication No. 2005-234499 discloses an image forming apparatus in which an RFID tag is placed on a side surface of a rotating member of a process cartridge.

However, in the technology disclosed in Japanese Patent Application Laid-Open Publication No. 2003-271042, each RFID tag has to be placed on the side surface of the fixing unit of the toner bottle including a toner supplying unit. This restricts the position where the RFID tag is to be placed, and also restricts the set position of the RFID reader to be placed so as to correspond to the RFID tags.

Moreover, the RFID tags have to be placed at the fixing units of the toner bottles so as to face the RFID reader placed between the toner bottles. Therefore, the toner bottles placed on right and left sides of the RFID reader have different structures on right and left sides, and therefore there is a problem in which the toner bottles cannot be used in common among respective colors. Furthermore, when the toner bottles are recycled, since each toner bottle has a different shape for each color, there is a problem in which the toner bottle used for each color cannot be recycled for use as a common toner bottle.

Also, in the technology disclosed in Japanese Patent Application Laid-Open Publication No. 2005-234499, the RFID tag is attached onto the side surface of the member in a cylindrical shape, such as a photosensitive member. Therefore, in order to make RFID tags face the RFID reader, an RFID reader has to be placed for each RFID tag. Thus, there is a problem in which, in the first place, the number of RFID readers to be placed cannot be reduced.

SUMMARY OF THE INVENTION

It is an object of the present invention to at least partially solve the problems in the conventional technology.

According to an aspect of the present invention, there is provided an image forming apparatus that includes a rotating member that is rotatable; a communication medium that is attached to an outer circumference of the rotating member, and that stores therein information on the rotating member and relays the information on the rotating member via wireless communication; and a receiving unit that receives the information on the rotating member from the communication medium.

According to another aspect of the present invention, there is provided a wireless communication apparatus that includes a rotating member that is rotatable; a communication medium that is attached to an outer circumference of the rotating member, and that stores therein information on the rotating member and relays the information on the rotating member via wireless communication; and a receiving unit that receives the information on the rotating member from the communication medium.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
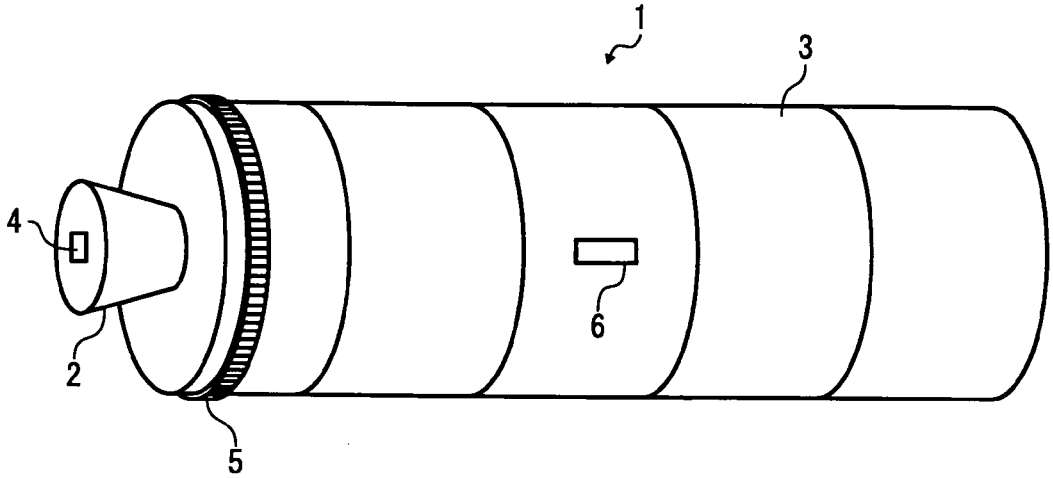
FIG. 1 is a perspective view of a toner bottle of a color copier according to an embodiment of the present invention.
Figure 2:
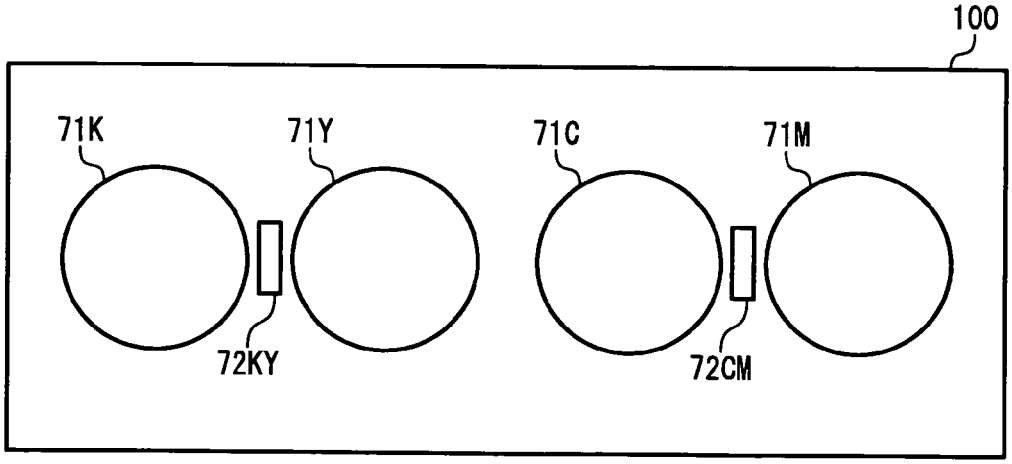
FIG. 2 is a side view of toner-bottle inserting portions of the image forming apparatus.
Figure 3:
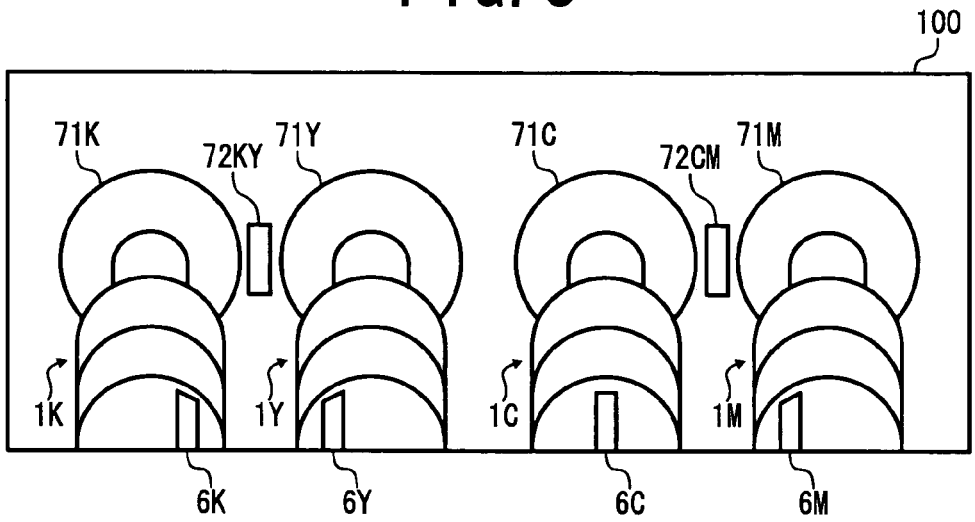
FIG. 3 is a schematic diagram for explaining a state of inserting the toner bottles shown in FIG. 1 into the toner-bottle inserting portions shown in FIG. 2.
Figure 4:
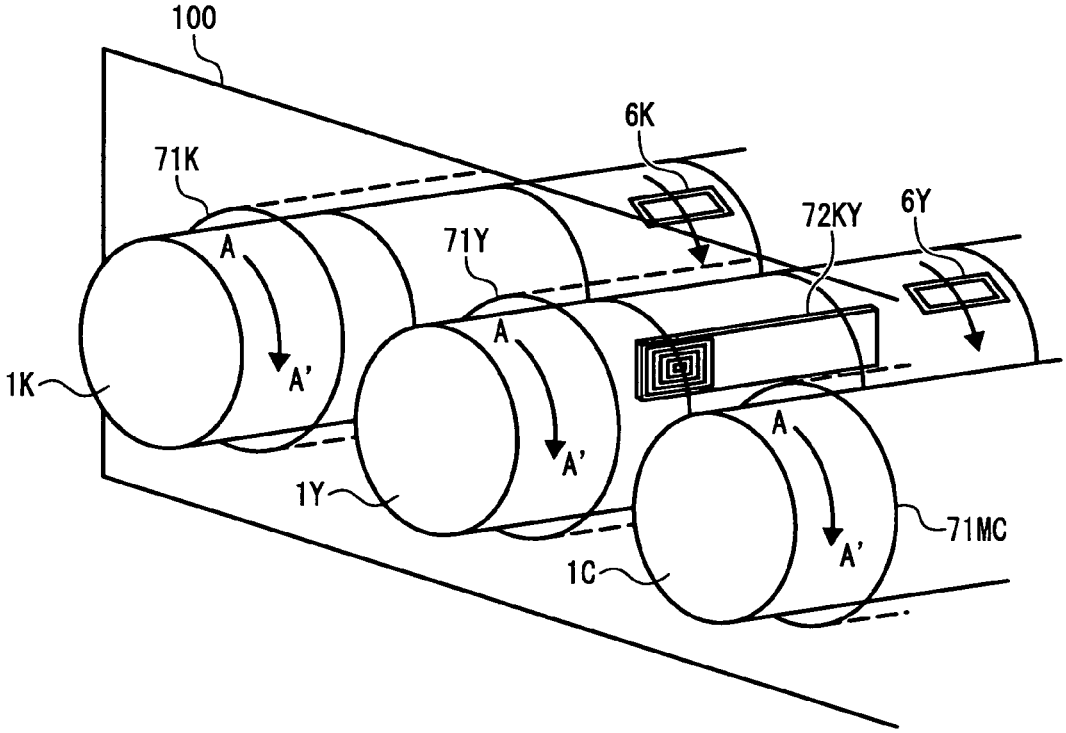
FIG. 4 is a perspective view for explaining a state of RFID communication between the toner bottles shown in FIG. 1 and the toner-bottle inserting portions shown in FIG. 2.

FIG. 1 is a perspective view of a toner bottle 1 of a color copier body 700 as an image forming apparatus according to an embodiment of the present invention. FIG. 2 is a side view of toner-bottle inserting portions 71 (71K, 71Y, 71C, and 71M). FIG. 3 is schematic diagram for explaining a state of inserting the toner bottles 1 (1K, 1Y, 1C, and 1M) into the toner-bottle inserting portions 71K, 71Y, 71C, and 71M. FIG. 4 is perspective view for explaining a state of RFID communication between the toner bottles 1 and the toner-bottle inserting portions 71.

In FIG. 1, the toner bottle 1 includes a fixing unit 2 and a rotating unit 3, with the fixing unit 2 being provided at one end of the rotating unit 2 in an axial direction. The fixing unit 2 includes a toner supplying unit 4 that delivers toner accommodated in the toner bottle 1 to a developing device side and rotatably supports the rotating unit 3. When the toner bottle 1 is attached to the image forming apparatus, the toner supplying unit 4 and a portion where toner supply is received on an image forming apparatus body side are connected together for supplying toner to the developing device, and therefore the fixing unit 2 is fixed to the image forming apparatus body. Furthermore, the rotating unit 3 has a cylindrical shape and is axially rotatable. With the rotating unit 3 itself rotating, the toner accommodated therein is conveyed to the toner supplying unit 4 of the fixing unit 2. A rotation of the rotating unit 3 to convey the toner to the toner supplying unit 4 of the fixing unit 2 is referred to as a forward rotation, whilst a rotation in reverse to the forward rotation is referred to as a reverse rotation, in which the toner is prevented from being conveyed to the toner supplying unit 4 of the fixing unit 2. The rotating unit 3 is provided along its outer perimeter with a gear 5, and the rotating unit 3 is driven for rotation by a driving gear not shown on the image forming apparatus body side that engages with the gear 5. Although the case is explained in the present embodiment as one example where the rotating unit 3 has toner accommodated therein, this is not meant to be restrictive. In place of toner, other powdery materials can be accommodated.

An RFID tag 6 is attached to the outer circumference of the rotating unit 3 of the toner bottle 1. The outer circumference of the rotating unit 3 is an outer surface of the rotating unit 3, and the RFID tag 6 can be attached to any position as long as it allows intermittent communication with an RFID reader/writer. For example, the position is not restricted to the center portion of the rotating unit 3 as depicted in FIG. 1, but can be a position at an end side near the fixing unit 2 or a position at an end side away from the fixing unit 2. This RFID tag 6 allows communication with the RFID reader/writer placed on the image forming apparatus body side, which will be explained further below. Also, the RFID tag 6 is not restricted to have a shape as depicted in FIG. 1, but can be in any of various shapes, such as a label type, card type, coin type, and stick type. Furthermore, a member placed on the outer circumference of the rotating unit 3 is not restricted to the RFID tag, but can be any as long as it allows transmission and reception of information to and from a control unit of the image forming apparatus side. The RFID tag 6 works as a non-contact communication storage medium.

The toner bottle 1 has a common structure for each color, although the information stored in the RFID tag 6 is varied for each color. The reason is as follows. Since the RFID tag 6 is attached to the outer circumference of the rotating unit 3 of the toner bottle 1 and moves to the inside of the communicable range of the RFID reader/writer according to the rotation of the rotating unit 3, the position of the RFID tag 6 to be placed is not required to be changed for each position where the toner bottle 1 for each color is placed at the image forming apparatus, thereby allowing commonality in structure of the toner bottle 1. Because the toner bottles 1 have a common structure, one of the toner bottles 1 can be recycled by rewriting various information including color information stored in the RFID tab 6 by using the RFID writer. That is, any color of toner can be accommodated in the toner bottle not depending on for which color the toner bottle was before.

In FIGS. 2 to 4, an image forming unit 100 is provided with the toner-bottle inserting portions 71K, 71Y, 71C, and 71M in which toner bottles having accommodated therein toner of four colors, that is, black (K), yellow (Y), cyan (C), and magenta (M), are removably inserted. In the following explanation, alphabetical subscripts attached to reference numerals represent toner colors. An RFID reader/writer 72KY is arranged between the toner-bottle inserting portions 71K and 71Y, whilst an RFID reader/writer 72CM is arranged between the toner bottle-inserting portions 71C and 71M. Also, according to the rotation of the rotating unit 3, each RFID reader/writer is placed at any position as long as the RFID tag 6 is within the range communicable with the RFID reader/writer when the RFID tags 6 are most close to the RFID reader/writer. Furthermore, when the communication distance is relatively short, the RFID reader/writer can be placed at a position where the RFID tags 6 face the RFID reader/writer through rotation. These RFID readers/writers 72KY and 72CM becomes in a state such that, when the toner bottles 1K and 1Y are inserted in the toner-bottle inserting portions 71K and 71Y and the toner bottles 1C and 1M are inserted in the toner-bottle inserting portions 71C and 71M, respectively, the RFID tags 6K and 6Y of the toner bottles 1K and 1Y and the RFID reader/writer 72KY can communicate with each other, whilst the RFID tags 6C and 6M of the toner bottles 1C and 1M and the RFID reader/writer 72CM can communicate with each other. The RFID readers/writers 72KY wirelessly exchanges information with the RFID tags 6K and 6Y or writes information in these tags, whilst RFID readers/writers 72CM wirelessly exchanges information with the RFID tags 6C and 6M or writes information in these tags. Hereinafter, the RFID tags are also simply referred to as "tags", whilst the RFID readers/writers are also simply referred to as "readers/writers"

In the present embodiment, the toner bottles 1 are rotated when the readers/writers 72 and the tags 6 communicate with each other. That is, as shown in FIG. 4, the toner bottle 1K is rotated at the time of toner supply, and in addition, at the time of communication. When the toner bottle 1K rotates, the tag 6K rotates according to this rotation in a direction indicated by an arrow A to A', periodically passing on a reader/writer 72KY side placed between the toner-bottle inserting portions 71K and 71Y. When the tag 6K comes close to the reader/writer 72KY, a response occurs between the tag 6K and the reader/writer 72KY, thereby establishing RFID communication. When the tag 6K goes away from the reader/writer 72KY, no response is present between the tag 6K and the reader/writer 72KY, and therefore RFID communication is not established. Thus, intermittent communication is performed according to the rotation of the toner bottle.

Figure 5:
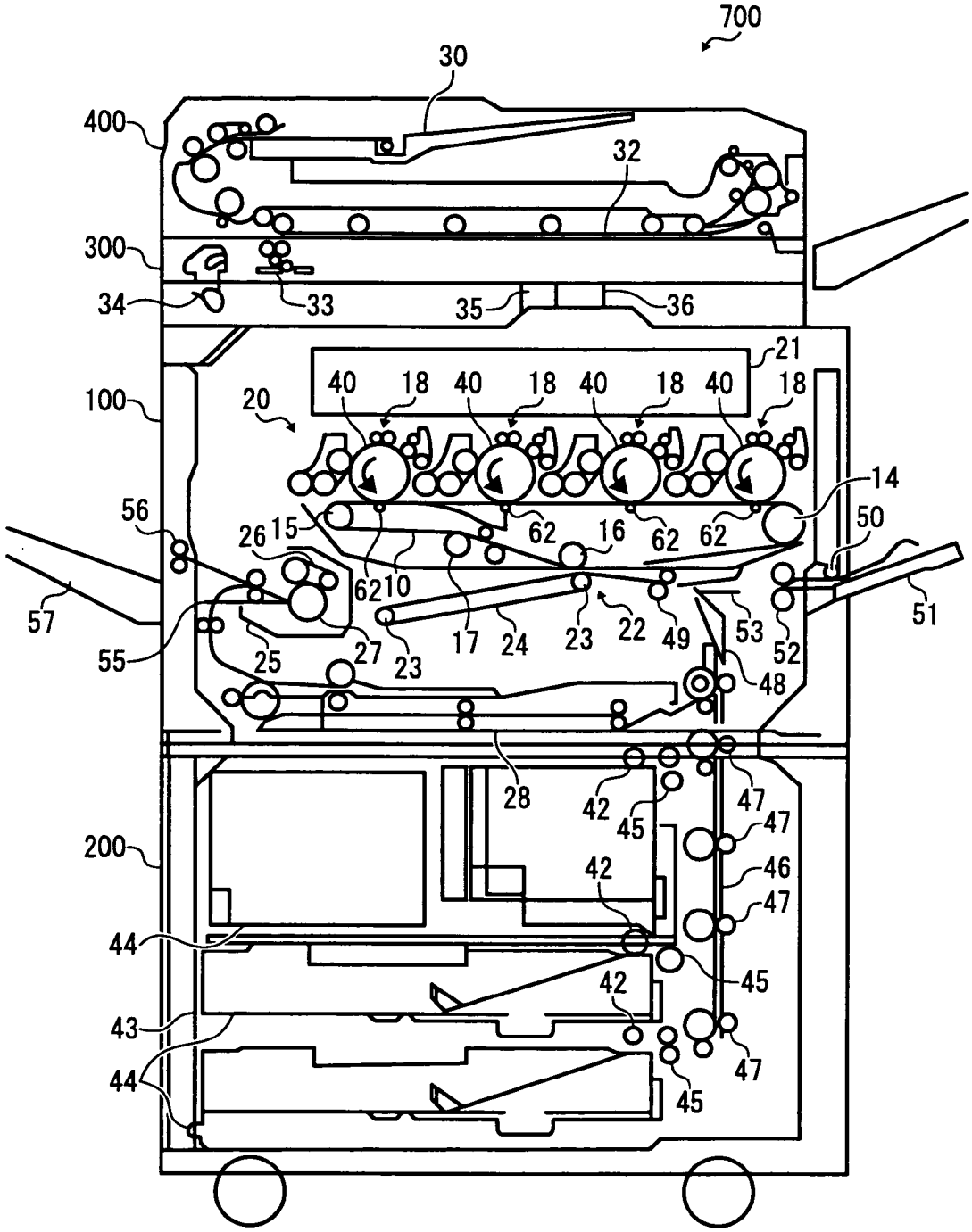
FIG. 5 is a side view for explaining a mechanical configuration of the color copier.

FIG. 5 is a side view of the color copier body 700. In FIG. 5, the color copier body 700 includes an image forming unit 100, a paper-feeding unit 200, a document reading unit 300, and an automatic document feeding (ADF) unit 400. The image forming unit 100 is mounted on the paper-feeding unit 200. The document reading unit 300 is mounted on the image forming unit 100. The automatic document feeding unit 400 is mounted on the document reading unit 300.

The image forming unit 100 is provided at its center with an intermediate transfer belt 10, which is in the form of an endless belt. The intermediate transfer belt 10 is wound around three supporting rollers 14, 15, and 16, has a front surface side in contact with an intermediate-transfer-belt cleaning roller 17, and rotates in a clockwise direction in FIG. 5. For this intermediate transfer belt 10, image-forming stations 18 for yellow (Y), cyan (C), magenta (M), and black (K) are provided in parallel. With photosensitive drums 40 of the respective image-forming stations 18 in contact with the intermediate transfer belt 10, an indirect tandem-type color image forming unit 20 is formed. With this configuration, toner images on the respective photosensitive drums 40 are sequentially transferred onto the intermediate transfer belt 10 from an upstream side in a rotating direction, thereby forming a full-color image with the toner image of the respective colors superposed each other. Primary transfer onto the intermediate transfer belt 10 from the photosensitive drums 40 are performed by primary transfer rollers 62.

Above the tandem-type color image forming unit 20, an optical writing device 21 that performs optical writing on each photosensitive drum 40 through optical scanning is provided. On the other hand, a secondary transfer device 22 is arranged on a side opposite to the tandem-type color image forming unit 20 across the intermediate transfer belt 10. The secondary transfer device 22 has a configuration such that a secondary transfer belt 24, which is an endless belt, is wound around two rollers 23, guiding a transfer sheet conveyed from the paper-feeding unit 200 side to a nip between the secondary transfer belt 24 and a driven roller 16 to transfer the full-color image on the intermediate transfer belt 10 onto the transfer sheet.

A fixing device 25 that fixes the transfer image on the transfer sheet is provided after the secondary transfer device 22. The fixing device 25 includes a fixing belt 26 and a pressure roller 27, heating and pressuring the transfer sheet while the transfer sheet passes through a space therebetween, thereby fixing the toner image onto the transfer sheet. The secondary transfer device 22 also includes a sheet conveying function of conveying to the fixing device 25 the transfer sheet after transfer. Here, needless to say, other types of components may be used as the secondary transfer device 22 and the fixing device 25. Also in the present embodiment, a reverse paper-feeding device 28 is provided below the secondary transfer device 22 and the fixing device 25 to reverse the transfer sheet for recording images on both sides of the transfer sheet for supply again to the tandem-type color image forming unit 20.

When a copy is made by using this color copier, a document is set on a document table 30 of the automatic document feeding unit 400, or a thick plate of the automatic document feeding unit 400 is opened for allowing a document to be set on a contact glass 32 of the document reading unit 300 and is then closed for pressing the document, and then a start switch on an operation panel 500 is pressed. With this, after the document is conveyed to move onto the contact glass 32 when the document is set at the automatic document feeding unit 400 or immediately after the switch is pressed when the document is set on the contact glass 32, the document reading unit 300 is driven to cause a first running member 33 and a second running member 34 to run. Then, at the first running member 33, light is emitted from a light source, and reflected light from the document surface is further reflected on the second running member 34 side, and then the reflected light is reflected by a mirror of the second running member 34 to be guided to an image-forming lens 35. At the image-forming lens 35, the incident reflected light from the document is used to form an image on an image-forming plane of a reading sensor 36, and the image read by the reading sensor 36 is subjected to optical-electrical conversion to obtain image data.

Also, when the start switch (not shown) is pressed, the three supporting rollers 14, 15, and 16 rotate for rotational conveyance of the intermediate transfer belt 10. Simultaneously, in individual image-forming stations 18, each photosensitive drum 40 rotates to form a single-color image of a relevant one of Y, C, M, or K on the photosensitive drum. Then, with the conveyance of the intermediate transfer belt 10, these single-color images are sequentially transferred to form a composite color image on the intermediate transfer belt 10.

On the other hand, when the start switch is pressed, one of paper-feeding rollers 42 in the paper-feeding unit 200 is selected for rotation. Transfer sheet are let out from one of paper-feeding cassettes 44 multiply provided in a paper-feeding unit 43, separated one by one at separation roller 45, guided by conveyor rollers 47 via a paper-feeding path 46 to a paper-feeding path 48 in the image forming unit 100, and then stopped by being struck at a registration roller 49. Alternatively, a transfer sheet is fed from a manual paper-feeding tray 51 through a paper-feeding roller 50, a separation roller 52, and a manual paper-feeding path 53, and is then stopped by being struck at the registration roller 49. Then, in timing with the composition color image on the intermediate transfer belt 10, the transfer sheet is sent from the registration roller 49 to a nip between the intermediate transfer belt 10 and the secondary transfer device 22, thereby transferring the image as explained above. After fixing in a manner as explained above, the transfer sheet with the image transferred thereon is delivered from delivery rollers 56 onto a paper delivery tray 57. A switching nail 55 performs switching between a paper delivery side and the reverse paper-feeding device 28. On the other hand, as for the intermediate transfer belt 10 after image transfer, residual toner left on the intermediate transfer belt 10 is removed by the intermediate-transfer-belt cleaning roller 17 after image transfer for preparation to image formation again by the tandem-type color image forming unit 20.

Figure 6:
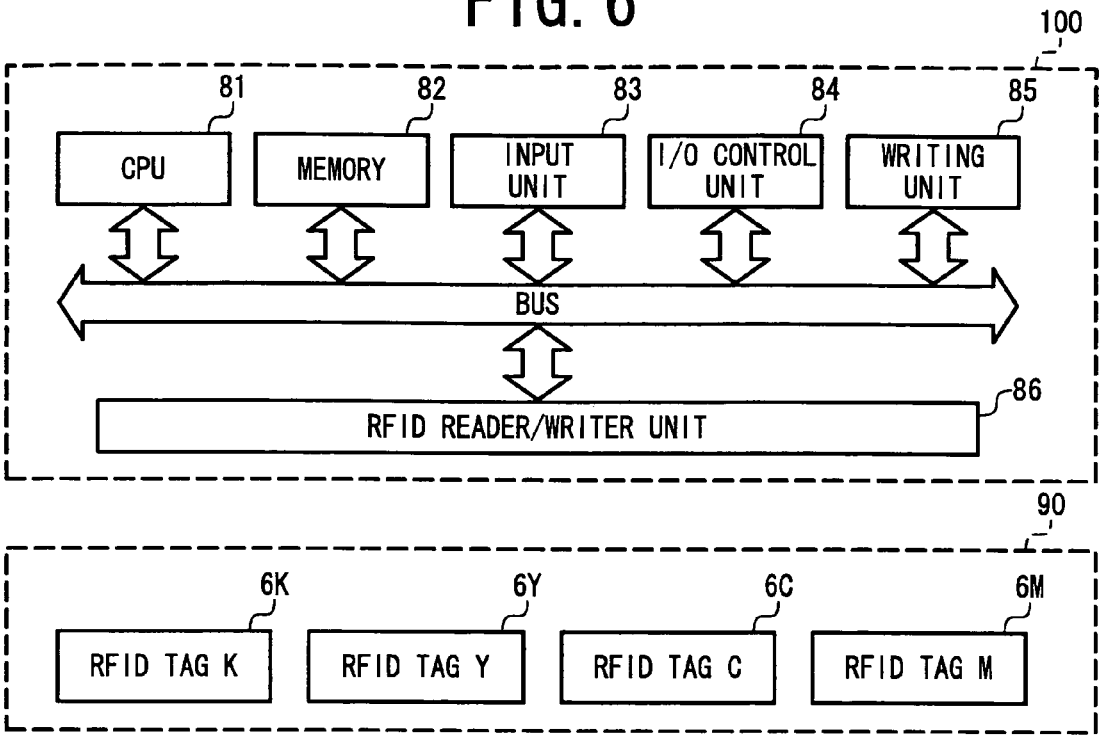
FIG. 6 is a block diagram of an electrical configuration of the color copier shown in FIG. 5.

FIG. 6 is a block diagram of an electrical configuration of the image forming unit 100 and an exchanging unit 90 of the color copier body 700. The image forming unit 100 includes a central processing unit (CPU) 81, a memory 82, an input unit 83, and an input/output (I/O) control unit 84, a writing unit 85, and an RFID reader/writer unit 86. The CPU 81 performs overall control over the color copier body 700. The memory 82 is a read-only memory (ROM) having a control program incorporated therein, a random access memory (RAM) providing a work area necessary for control, a non-volatile random access memory (NV-RAM) storing various types of information necessary for control, or others. The input unit 83 receives an input from a printer controller or image data from the document reading unit 300. The I/O control unit 84 controls over various electrical components, such as motors and solenoids. The writing unit 85 corresponds to the optical writing device 21. The RFID reader/ writer unit 86 includes an antenna for wireless communication. The exchanging unit 90 is to accommodate four toner bottles 1K, 1Y, 1C, and 1M, performing wireless communication with the tags 6K, 6Y, 6C, and 6M provided to the toner bottles 1K, 1Y, 1C, and 1M, respectively, and exchanging various types of information, such as color information.

Figure 7:
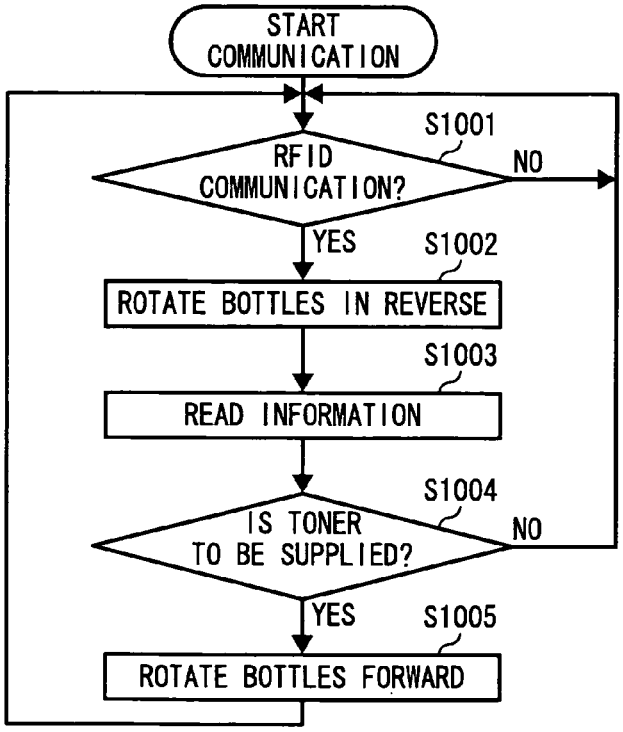
FIG. 7 is a flowchart for explaining a toner-bottle rotation control operation.

FIG. 7 is a flowchart of a toner-bottle rotation control operation. At the time of RFID communication, each of the toner bottles 1K, 1Y, 1C, and 1M is rotated in a direction reverse to the direction at the time of toner supply. That is, when RFID communication starts, it is determined from the RFID reader/writer unit 86 whether RFID communication is to be performed (step S1001). If RFID communication is to be performed, the rotating direction of each of the toner bottles 1K, 1Y, 1C, and 1M is set in reverse for rotation (step S1002). Next, information is intermittently read through RFID communication (step S1003). From the read information, whether toner supply is required is determined (step S1004). If toner supply is required, the rotating direction of each of the toner bottles 1K, 1Y, 1C, and 1M is returned to the forward direction for rotation (step S1005).

With the rotating unit 3 of each toner bottle 1 being rotated in this manner, information is intermittently sent from the RFID tag 6 to the RFID reader/writer 72. For example, compared with the image forming apparatus configured in a manner such that the RFID tag and the RFID reader/writer are fixed and the distance between the RFID tag and the RFID reader/writer is always within a communication distance allowing information to be always obtained, the timing of obtaining information is not required to be controlled at the RFID reader/writer side. This simplifies control of the RFID reader/writer. Also in the present embodiment, the rotating unit 3 is rotated in reverse to obtain information from the RFID tag 6. Therefore, at the time of obtaining information, toner is not conveyed, thereby preventing wasteful toner supply. Here, in place of reverse rotation of the rotating unit 3, information may be obtained from the RFID tag 6 during forward rotation.

If the toner bottles 1 are inserted into the image forming apparatus so as to correctly place each position where the RFID tag 6 is attached in one direction (for example, when the toner bottles 1 are inserted so that a longitudinal direction thereof matches a horizontal direction, if all toner bottles 1 are inserted so that the RFID tags 6 are positioned downward in a vertical direction), timings of receiving information from the RFID tags 6 differ from each other, and timings of receiving information from adjacent toner bottles 1 are not the same.

Figure 8:
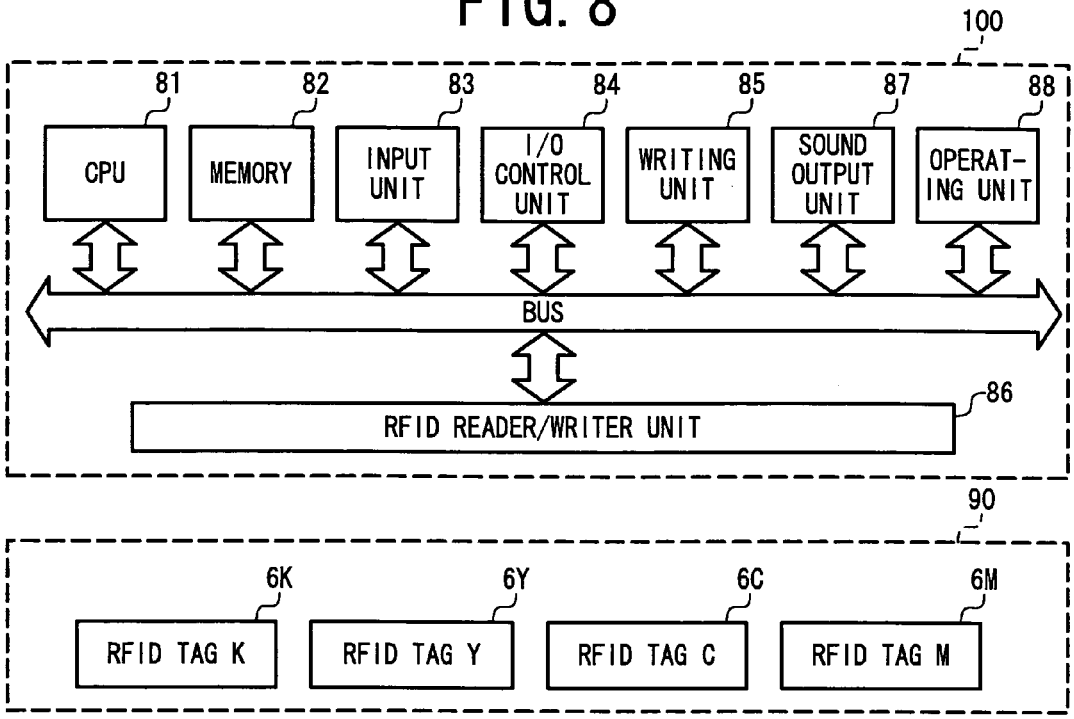
FIG. 8 is a block diagram of an electrical configuration of a color copier according to a modification of the present invention.

FIG. 8 is a block diagram of an electrical configuration of the image forming unit 100 and the exchanging unit 90 of the color copier body 700 according to a modification of the present invention. At the time of RFID communication, if the read color information (which means in the following a value indicative of color) do not match color information previously set, an alert sound is produced or an alert sign is displayed on an operating unit. The configuration of this embodiment is identical to that depicted in FIG. 6 except that a sound output unit 87 that outputs a sound, such as an alert sound, and an operating unit 88 that displays the current state of image forming apparatus or receives an input for a copy operation through a user operation. Therefore, redundant explanation is omitted, and only the different points are explained below.

In the block diagram depicted in FIG. 8, the image forming unit 100 depicted in FIG. 6 is provided with the sound output unit 87 and the operating unit 88 in addition to the components explained above.

Figure 9:
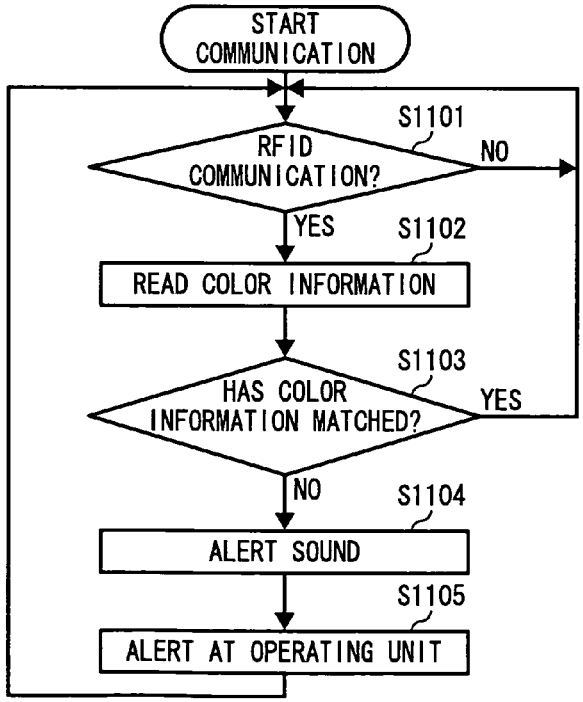
FIG. 9 is a flowchart of an alert-sound producing operation.

FIG. 9 is a flowchart of an alert-sound producing operation. In this operation procedure, at the time of starting RFID communication, it is first determined from the RFID reader/writer unit 86 whether RFID communication is to be performed (step S1101). If RFID communication is to be performed, color information is transmitted and received between the RFID reader/writer unit 86 and the RFID tags 6K, 6Y, 6C, and 6M (step S1102) to see if the color values match with each other (step S1103). If they do not match, an alert sound is produced (step S1104), and an alert is further displayed on the operating unit 88 (step S1105). If the color information has matched at step S1103, the procedure returns to step S1101.

Figure 10:
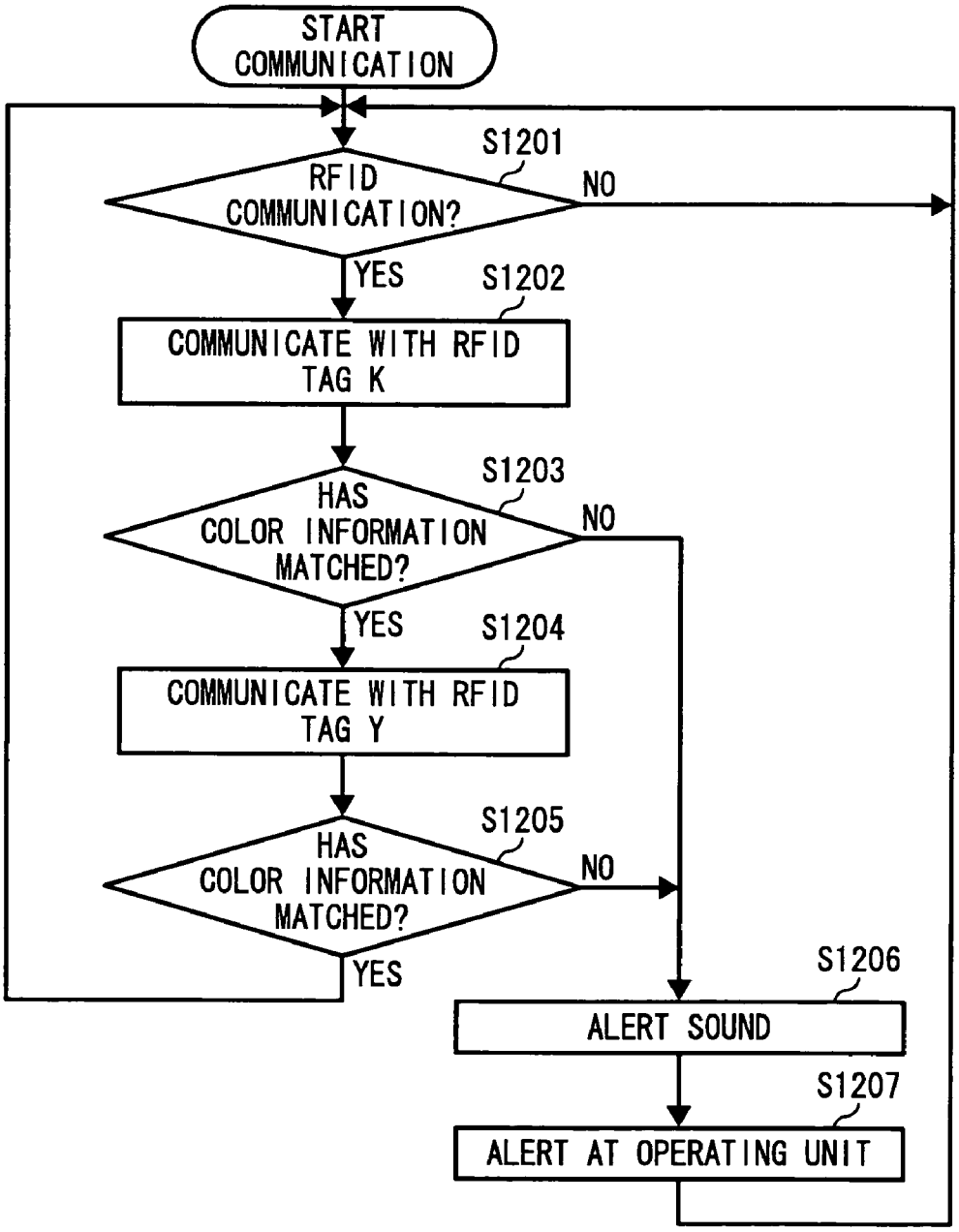
FIG. 10 is a flowchart of an operation for time-division control over RFID tags of adjacent toner bottles of different colors.

FIG. 10 is a flowchart for explaining an operation for time-division control over RFID tags of adjacent toner bottles of different colors. The case is taken as an example in which the toner bottles 1K and 1Y are controlled. First, at the time of starting RFID communication, it is determined from the RFID reader/writer unit 86 whether RFID communication is to be performed (step S1201). If RFID communication is to be performed, color information is transmitted and received between the RFID reader/writer unit 86 and the RFID tags 6K (step S1202) to see if the color values match with each other (step S1203). If they do not match, an alert sound is produced and an alert is further displayed on the operating unit 88 (steps S1206 and S1207), and the process control returns to step S1201.

If the color information has matched at the determination at step S1203, the information in the tag 6Y and the color information are transmitted and received (step S1204) to see if the color information has matched (step S1205). If the color information has matched, the procedure returns to step S1201 to repeat the next process. If the color information has not matched, an alert sound is produced and an alert is further displayed on the operating unit 88 (steps S1206 and S1207), and the process control returns to step S1201. For another set of adjacent toner bottles 1C and 1M, a process similar to that from steps S1201 to S1207 is performed, thereby checking whether the color information has matched.

Figure 11:
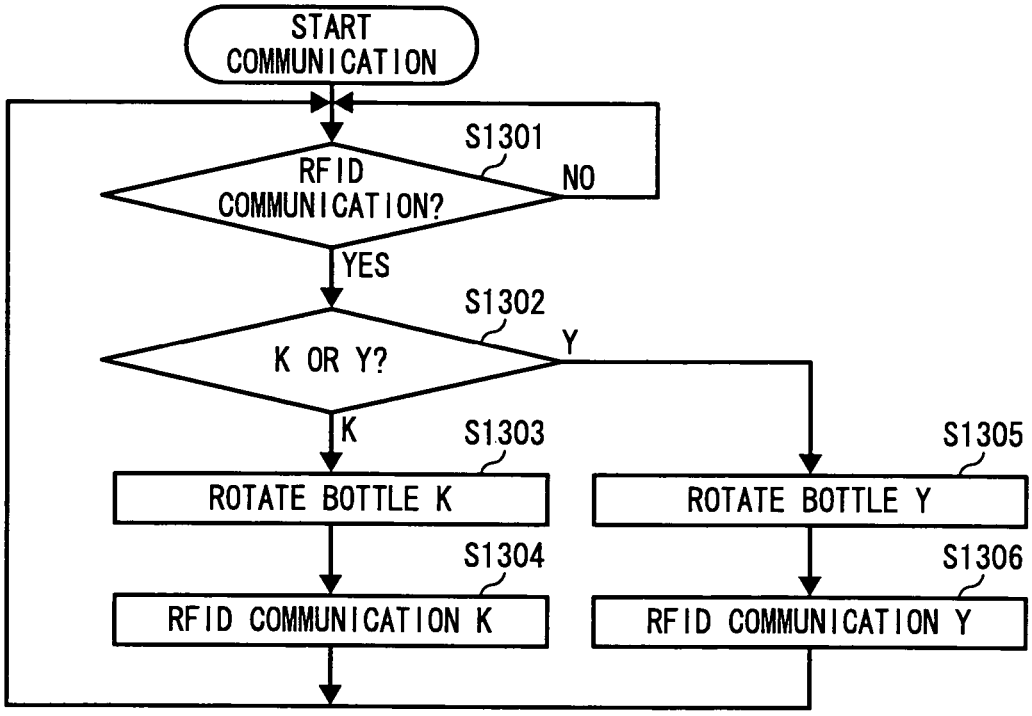
FIG. 11 is a flowchart for explaining a toner-bottle rotation control in which a specified toner bottle rotates for RFID communication.

FIG. 11 is a flowchart for explaining a toner-bottle rotation control for selective RFID communication. When RFID communication is performed, as explained above, the toner bottles are rotated in a direction reverse to the direction at the time of toner supply. Therefore, at the time of starting RFID communication, it is determined from the RFID reader/writer unit 86 whether RFID communication is to be performed (step S1301) to select a bottle of color for RFID communication. In this flowchart, by way of example, K or Y is a target for selection. Therefore, either K or Y is selected (step S1302). When K is selected, only the toner bottle 1K is rotated in reverse (step S1303) and the other toner bottles are not rotated. With this, the reader/writer 72KY performs RFID communication with the rotated toner bottle 1K and tag 6K (step S1304). Similarly, when Y is selected, only the toner bottle 1Y is rotated (step S1305) and the other toner bottles are not rotated. With this state, the reader/writer 72KY performs RFID communication with the rotated toner bottle 1Y and tag 6Y (step S1306).

Figure 12:
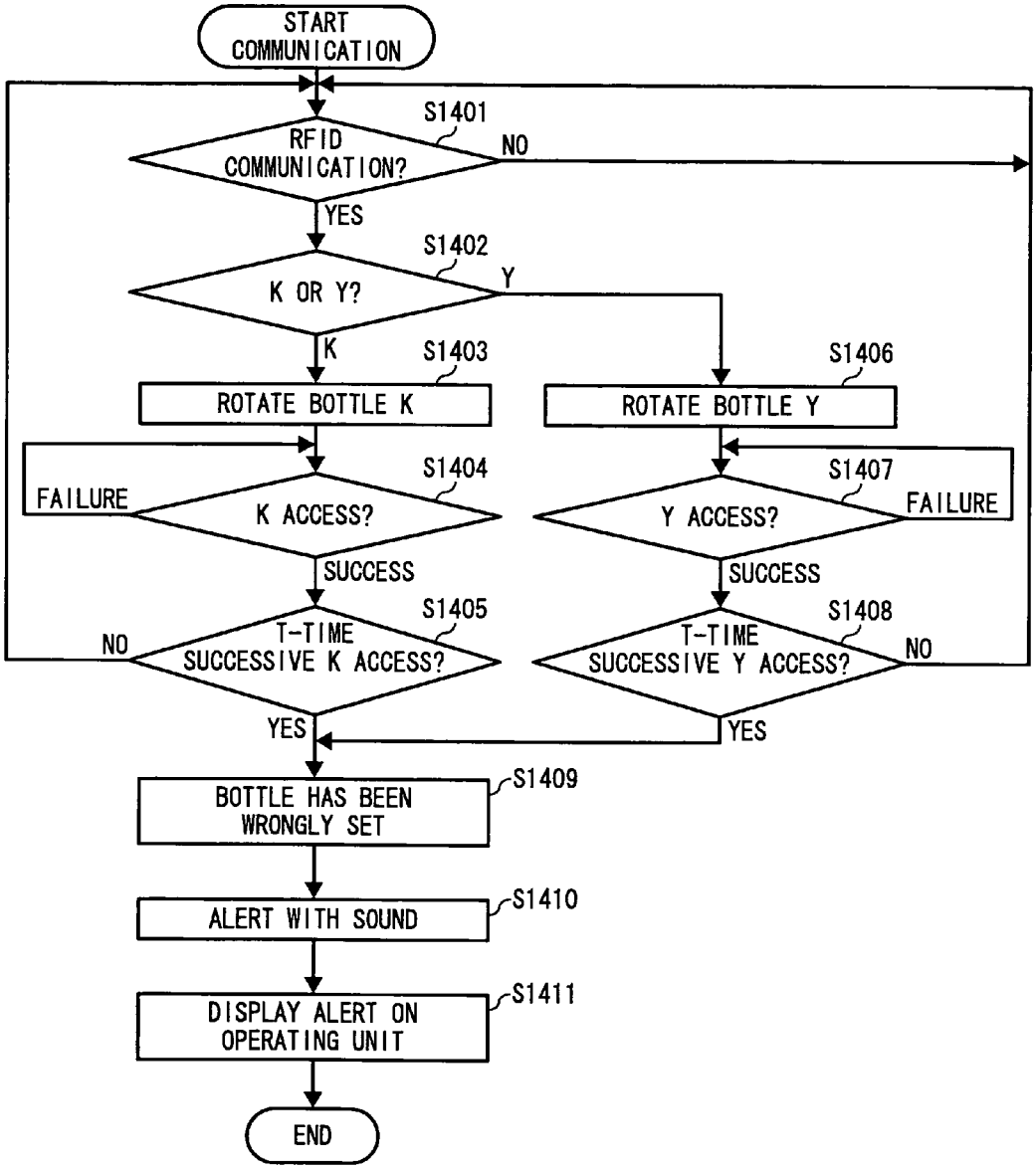
FIG. 12 is a flowchart for explaining control over an operation of determining whether any toner bottle has been wrongly set.

If the color information has not matched in the flowchart of FIG. 10, this is often due to the fact that any toner bottle has been wrongly set. Therefore, it is required check whether any toner bottle has been wrongly set. FIG. 12 is a flowchart of a control procedure of determining whether any toner bottle has been wrongly set.

In this wrong-set determination, at the time of starting RFID communication, it is first determined from the reader/writer unit 86 whether RFID communication is to be performed (step S1401). Next, a color desired for RFID communication is selected. Here, K and Y are exemplarily depicted, and therefore either K or Y is selected (step S1402). It is assumed herein that K is selected and communication with the toner bottle 1K for K is desired, only the toner bottle 1K is rotated in reverse (step S1403), and the other bottles are not rotated. Next, the tag 6K attached to the rotating unit 3 of the toner bottle 1K is accessed (step S1404) and, if accessed successfully, it is checked whether access has been successfully made successively T times (step S1405). If access has been successfully made successively T times, it is assumed that the toner bottle has been wrongly set (step S1409), and an alert sound is produced from the sound output unit 87 (step S1410), and an alert is further displayed on the operating unit 88 (step S1411). Here, "T" for T times is the number of times arbitrarily set and, for example, is set at four to five times and more. Also, "access has been successfully made successively T times" means that information has been received from the toner bottle 1 that is not rotating. That is, the toner bottles 1 are mechanically and physically identical to each other irrespectively of color, and only the information stored in the tags 6 is different. Since communication with tags 6 of two toner bottles 1 is made by a single reader/writer 72, if the toner bottles 1 of colors on both sides of the single reader/writer 72 change their places, the information read by the reader/writer 72 is the same, and therefore the color of the ink bottles 1 cannot be determined by the RFID reader/writer unit 86. On the other hand, at the time of communication, only one of the four toner bottles is rotated. Therefore, at the time of communication with the tag 6 of the target toner bottle 1, T-time accesses indicate that the target toner bottle 1 is not rotated. If the target toner bottle is set at the correction position, the position of the tag 6 is supposed to be changed with rotation, and therefore the possibility of plural successive accesses is very low. Thus, if access has been made successively T times between the target toner bottle 1 and the tag 6, it is assumed in the present embodiment that the target toner bottle 1 has been wrongly set.

On the other hand, similarly, when communication with Y is selected at step S1402, only the toner bottle 1Y is rotated (step S1406), and the other bottles are not rotated. Next, the tag 6Y attached to the rotating unit 3 of the toner bottle 1Y is accessed to check whether access is successfully made (step S1407). If access has been successfully made successively T times (step S1408), it is assumed that the target toner bottle has been wrongly set (step S1409), an alert sound is produced from the sound output unit 87 (step S1410), and an alert is further displayed on the operating unit 88 (step S1411).

Figure 13:
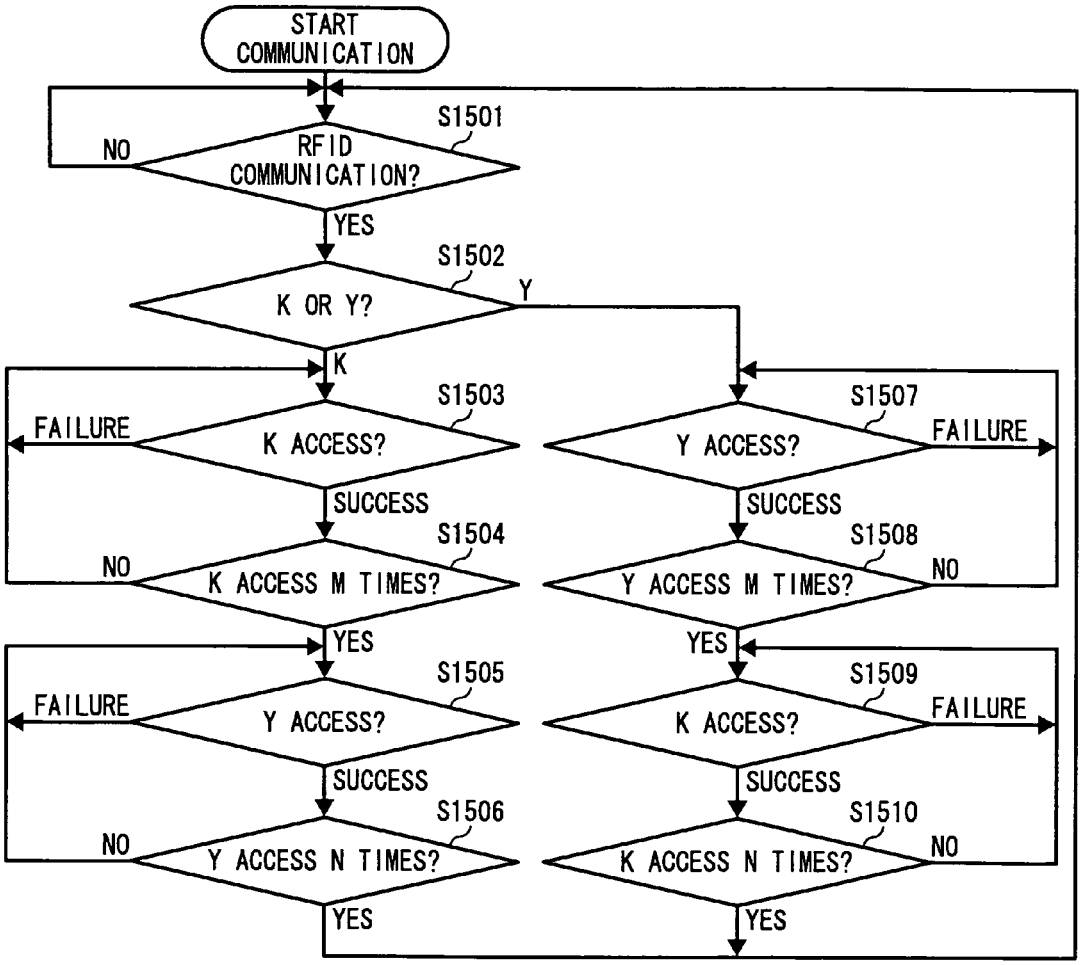
FIG. 13 is a flowchart of an operation of alternately rotating paired toner bottles.

In FIG. 12, the case has been explained in which RFID communication is selectively performed. FIG. 13 is a flowchart of an operation of alternately rotating paired toner bottles. In this control, after one toner bottle is rotated and RFID communication is performed M times, the other toner bottle is rotated and RFID communication is performed N times. That is, at the time of starting RFID communication, it is determined from the reader/writer unit 86 whether RFID communication is to be performed (step S1501), and a color desired for RFID communication, for example, K or Y, is selected (step S1502). When communication is made with K, for example, the tag 6K is accessed (step S1503), and then it is checked whether the tag 6K has been successfully accessed M times (step S1504). If the tag 6K has been successfully accessed M times, the tag 6Y is then accessed (step S1505). The tag Y is accessed until N-time access is established (step S1506).

On the other hand, similarly, when Y is the color desired for RFID communication, the tag 6Y is accessed (step S1507), and if the tag 6Y has been accessed M times (step S1508), the tag 6K is then accessed (step S1509). The tag 6K is accessed until N-time access is established (step S1510).

Figure 14:
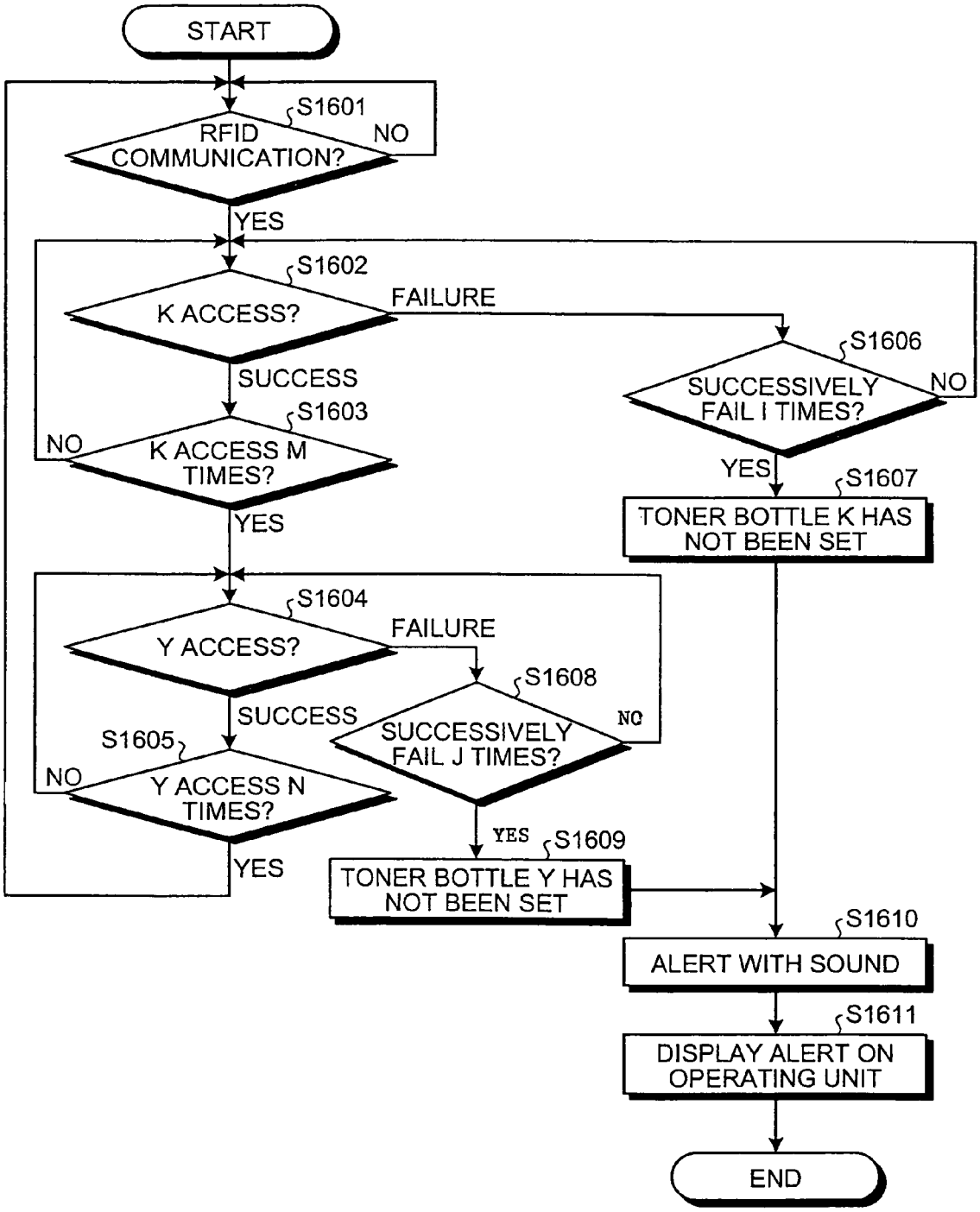
FIG. 14 is a flowchart of an operation for determining whether any toner bottle has not been set.

FIG. 14 is a flowchart of a control operation for determining whether any toner bottle has not been set. At the time of starting RFID communication, it is determined from the reader/writer unit 86 whether RFID communication is to be performed (step S1601). Then, when communication with K is desired, for example, the tag 6K is accessed to check whether communication with reader/writer 72 is established (step S1602). If the communication with the tag 6K is established, it is then determined whether the tag 6K has been accessed M times (step S1603). If communication with the tag 6K fails successively I times (step S1606), it is determined that the toner bottle 1K has not been set (step S1607). Then, an alert sound is produced from the sound output unit 87 (step S1610), and an alert is further displayed on the operating unit 88 (step S1611).

After M-time access between the reader/writer 72KY and the tag 6K (step S1603), the tag 6Y is then accessed (step S1604). If communication with the tag 6Y is established, it is further determined whether the tag 6Y has been accessed N times (step S1605). If communication with the tag 6Y and the reader/writer 72KY fails successively J times (step S1608), it is determined that the toner bottle 1Y has not been set (step S1609). Then, an alert sound is produced from the sound output unit 87 (step S1610), an alert is further displayed on the operating unit 88 (step S1611). On the other hand, if it is determined at step S1605 that the tag 6K has been accessed N times, the procedure returns to step S1601 similarly at the time of starting communication, repeating the subsequent processes.

In the explanation above, toner bottles for electrophotographic system are taken as an example of rotating members. However, the rotating member can be applied to other exchangeable units, such as photosensitive members, and ink bottles of an ink-jet type. The RFID tag is attached to a rotatable object whose life is necessary to be managed, such as a toner bottle or a photosensitive member.

Here, in the embodiments, the case has been explained in which the RFID reader/writer is applied. In place of the RFID reader/writer, an RFID reader can be applied to receive information stored in the RFID tag, such as color information, thereby performing the process explained above.

The case has been explained in which the RFID tag 6 is attached to the rotating unit 3 of the toner bottle 1 in an irremovable manner. Alternatively, the RFID tag 6 may be removable and, at the time of recycling, after cleaning with the RFID tag 6 being removed, an RFID tag 6 having stored therein information corresponding to toner for accommodation is attached. With this, a recycling operation can be facilitated, thereby improving recycling efficiency.

Furthermore, the present invention is not restricted to be applied to the image forming apparatus, and can be applied to an apparatus in which an RFID tag is placed on a removable rotating member and it is required to detect an error in set position based on information received from the RFID tag. For example, the present invention can be applied to a case such that an RFID tag is placed on a rotating member for use in an automobile.

According to an embodiment of the present invention, the non-contact communication storage medium (RFID tag) is placed on the outer circumference of the rotating member. With this, the RFID tag moves to the inside of a communicable range of the receiving unit (RFID reader) according to the rotation of the rotating member. This allows the single RFID reader to receive information from the RFID tags, thereby reducing the number of RFID readers to be placed. Also, with the RFID tag being placed on the outer circumference of the rotating member, each RFID tag moves according to the rotation of the rotating member to allow communication with RFID reader. Therefore, the positions of the RFID tags placed on the image forming apparatus of the rotating member are not required to be varied, thereby allowing a common structure of the rotating member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a plurality of rotating members that are rotatable;

a communication medium that is attached to an outer circumference of the rotating members, and that stores therein information on the rotating members and relays the information on the rotating members via wireless communication; and a receiving unit that receives the information on the rotating members from the communication medium.

2. The image forming apparatus according to claim 1, further comprising a supplying unit that supplies powder to the image forming apparatus, wherein the rotating members are supported by the supplying unit in a rotatable manner and powder in the rotating members are moved to the supplying unit while the rotating members rotate.

3. The image forming apparatus according to claim 1, wherein the image forming apparatus further comprises a control unit that causes each of the rotating members to rotate, and the receiving unit receives information on the rotating members intermittently from the communication media while the rotating members rotate.

4. The image forming apparatus according to claim 3, wherein the receiving unit sequentially receives the information on the rotating members from each of the communication media as the rotating members rotate.

5. The image forming apparatus according to claim 3, further comprising a second receiving unit that receives information on a specific one of the rotating members, wherein the control unit causes the specific rotating member to rotate, and the receiving unit receives the information on the specific rotating member from a communication medium attached to the specific rotating member.

6. The image forming apparatus according to claim 3, further comprising a determining unit that counts a first number of successive receiving of the information on the rotating members by the receiving unit, determines whether the first number is a first threshold or larger, and determines, when determining that the first number is the first threshold or larger, that the rotating members are set at a wrong position.

7. The image forming apparatus according to claim 6, wherein the determining unit counts a second number of intermittent receiving of the information on the rotating members by the receiving unit, determines whether the second number is a second threshold or larger, and determines, when determining that the second number is the second threshold or larger, that the rotating members are set at a correct position.

8. The image forming apparatus according to claim 6, wherein the determining unit counts a third number of receiving of the information on the rotating members by the receiving unit, determines whether the third number is a third threshold or larger, and determines, when determining that the third number is smaller than the third threshold, that the rotating members are not set.

9. The image forming apparatus according to claim 3, wherein the control unit causes each of the rotating members to rotate in any one of a first direction for supplying the powder and a second direction that is reverse to the first direction.

10. The image-forming apparatus according to claim 9, wherein the receiving unit is placed between the rotating members.

11. The image forming apparatus according to claim 3, wherein each of the rotating members is a toner bottle that houses a toner in a single color different from each other.

12. The image forming apparatus according to claim 3, further comprising an alerting unit that produces an alert when the receiving unit receives from the communication medium information on the rotating members different from predetermined information.

13. The image forming apparatus according to claim 1, wherein the receiving unit is placed at a position so that, out of distance between the receiving unit and the communication medium that varies as the rotating member rotates, a closest distance is less than a communicable range of the receiving unit and the communication medium.

14. The image forming apparatus according to claim 13, wherein the receiving unit is placed at a position so as to be opposite to the communication medium.

15. The image forming apparatus according to claim 14, wherein the receiving unit is placed between the rotating members.

16. The image forming apparatus according to claim 13, wherein each of the rotating members is a toner bottle that houses a toner in a single color different from each other.

17. The image forming apparatus according to claim 13, further comprising an alerting unit that produces an alert when the receiving unit receives from the communication medium information on the rotating members different from predetermined information.

18. A wireless communication apparatus comprising:

a plurality of rotating members that are rotatable;

a communication medium that is attached to an outer circumference of the rotating members, and that stores therein information on the rotating members and relays the information on the rotating members via wireless communication; and a receiving unit that receives the information on the rotating members from the communication medium.

19. An image forming apparatus, comprising:

the wireless communication apparatus of claim 18; and a control unit that causes each of the rotating members to rotate, wherein the receiving unit receives information on the rotating members intermittently from the communication media while the rotating members rotate.

* * * * *